United States Patent [19]

Dumas et al.

[11] Patent Number: 4,682,181

[45] Date of Patent: Jul. 21, 1987

[54] FLUSH MOUNTED TACAN BASE STATION ANTENNA APPARATUS

[75] Inventors: Theodore A. Dumas, Dallas, Tex.; Leslie V. Griffee, Marysville, Kans.

[73] Assignee: Rockwell International Corporation, El Segundo, Calif.

[21] Appl. No.: 725,962

[22] Filed: Apr. 22, 1985

[51] Int. Cl.[4] ..... H01Q 1/38; H01Q 3/24

[52] U.S. Cl. ..... 343/789; 343/846; 343/853; 342/399

[58] Field of Search ..... 343/789, 700 MS, 853, 343/846, 872, 708, 824, 374, 399, 433–435; 342/374, 399, 433–435

[56] References Cited

U.S. PATENT DOCUMENTS

| | | | |
|---|---|---|---|
| 4,074,268 | 2/1978 | Olson | 343/399 |
| 4,287,518 | 9/1981 | Ellis | 343/700 MS |
| 4,510,498 | 4/1985 | Mori et al. | 343/700 MS |
| 4,540,988 | 9/1985 | Munk et al. | 343/789 |

FOREIGN PATENT DOCUMENTS

| | | | |
|---|---|---|---|
| WO81/03398 | 11/1981 | PCT Int'l. Appl. | 343/846 |

*Primary Examiner*—William L. Sikes
*Assistant Examiner*—Michael C. Wimer
*Attorney, Agent, or Firm*—Bruce C. Lutz; V. L. Sewell; H. Fredrick Hamann

[57] ABSTRACT

A flush-mounted radiating antenna is disclosed which can be electronically switched to produce a rotating directional field with no moving parts in the antenna element itself or with the appropriate electronics in the entire mechanism. This is accomplished by utilizing pie-shaped sections on the flush surface which are capacitively coupled to a central feed element and shorting some of the pie-shaped capacitively coupled elements to a ground plane whereby the normally omnidirectional pattern is perturbed to a directional pattern.

2 Claims, 2 Drawing Figures

FLUSH MOUNTED TACAN BASE STATION ANTENNA APPARATUS

THE INVENTION

The present invention is generally concerned with electronics and more specifically concerned with antennas. Even more specifically the invention is concerned with a method of electronically directing the radiated output signal from a flush mounted antenna whereby there are no moving parts.

PRIOR ART

A recently filed and co-pending application Ser. No. 691,335, now U.S. Pat. No. 4,631,546, describes a surface mounted antenna using a central radiating element surrounded by signal reflector/director stubs. The stubs are electronically switched to conditions where they either reflect the signal or help direct the signal. This produces a directional signal. The design is such that there are projections from the skin of the airplane. When aircraft is flown at supersonic speeds, not only are airflow patterns vitally important to the operation of the aircraft but the integrity of any device projecting into the airstream can be seriously affected.

It was thus important that an antenna be designed which while remaining electronically directable have a flush surface. The present invention uses a central radiating element in a cavity with a centrally located capacitively coupled element flush with the aircraft surface. When no modification of the capacitively coupled element is provided, an omnidirectional signal emanates from the area between the edge of the cavity and the capacitively coupled element. However, if the capacitively coupled element is divided into a plurality of segments and a small number of adjacent segments are electronically connected to the same ground as the edge of the cavity, the normally omnidirectional transmitting signal is unbalanced such that a directional transmitting signal is obtained.

Because of the mechanical configuration of the capacitive elements, it is believed that they do not act as reflectors or directors as in the referenced prior art, but rather merely unbalance the normal omnidirectional signal to provide a directional signal. Such an occurrence has been proven with field measurements of this device.

It is therefore an object of the present invention to provide an improved flush mounted antenna for use in supersonic applications.

Other objects and advantages of the present invention may be ascertained from a reading of the specification and appended claims in conjunction with the drawings wherein:

FIG. 1 is a cross-sectional view of a flush mounted antenna device according to the teachings of the present invention; and FIG. 2 is a schematic representation of the switched electronic system including a representation of the directional field of the antenna.

DETAILED DESCRIPTION

Figure 1:
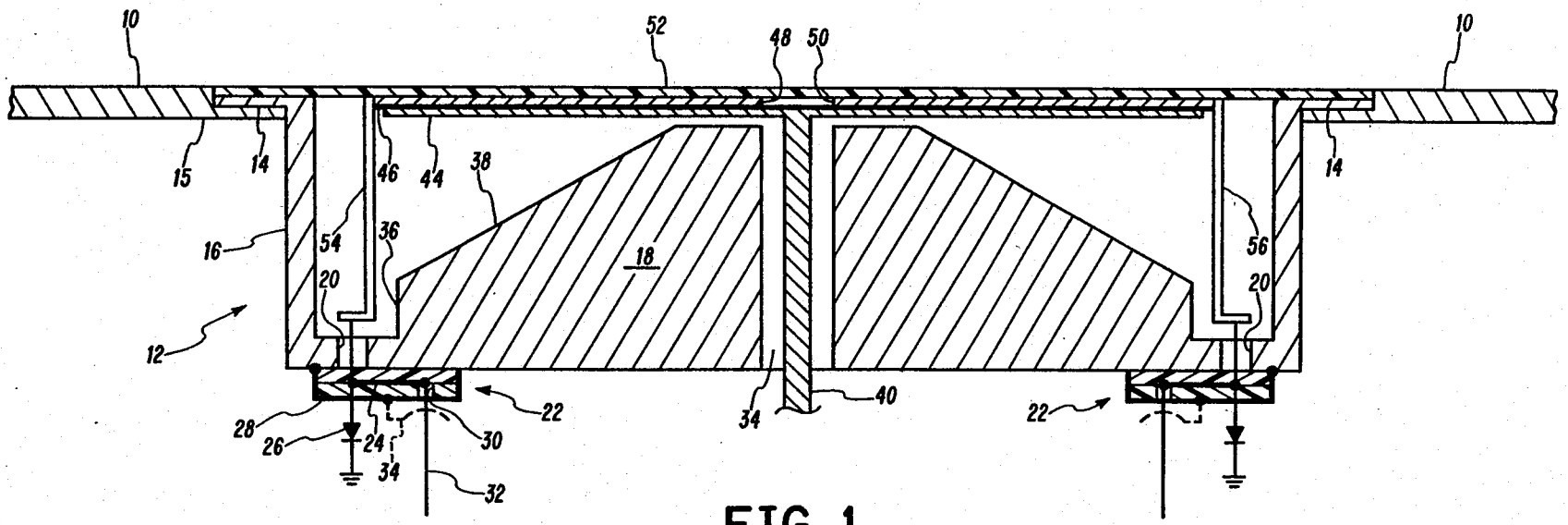

In FIG. 1 a ground plane 10 is illustrated. This ground plane may be the outer surface of an airplane or similar device wherein it is desired to mount a flush antenna. The ground plane 10 has an opening into which is inserted a recessed container 12 having flanges or rim portions 14. The rim portion 14 is seated adjacent a lip 15 of the ground plane 10. The cavity or box 12 includes a conical toroid shaped center portion generally designated as 18, skirts 16 and openings 20 in a lower portion thereof for the passage of electrical wires. In addition, a plurality of electrical circuit components 22 are illustrated each comprising a pair of printed circuit boards having a quarter-wavelength conductor 24, a diode 26 and a wrap-around ground plane conductor 28. An opening 30 in one of the printed circuit boards 22 allows passage of an electrical conductor 32 which is connected at one end to the quarter-wavelength conductor 24. A dash line capacitor 34 is illustrated representing the capacitance from a feed through capacitance as would be used in the opening 30 in the lower printed circuit board 22.

Returning to the toroid 18, it will be noted that it has a central opening or cavity 34 and an outer edge 36. With a sloping surface 38 extending upwardly towards the central portion 34 of the toroid 18. Situated in the middle of the opening 34 of toroid 18 is an electrical feed conductor 40 for connection to a radio frequency source which supplies electric signals to a conductive circular disk 44. Attached to the upper surface of disk 44 is an insulator 46. On top of insulator 46 is an assemblage of pie shaped elements. Two of these pie-shaped elements 48 and 50 are shown and designated in the cross section of FIG. 1. Flush with the surface of ground plane 10 and on top of the pie-shaped elements 48 is a dielectric radome 52. An electrical connection 54 connects the pie-shaped element 48 to the quarter-wavelength line 24 and the diode 26. A similar conductor 56 is shown on the righthand side but the further elements in the electrical circuit below connector 56 are not designated since they are a substantial repeat of that on the lefthand side and will be discussed in more detail in FIG. 2.

Figure 2:
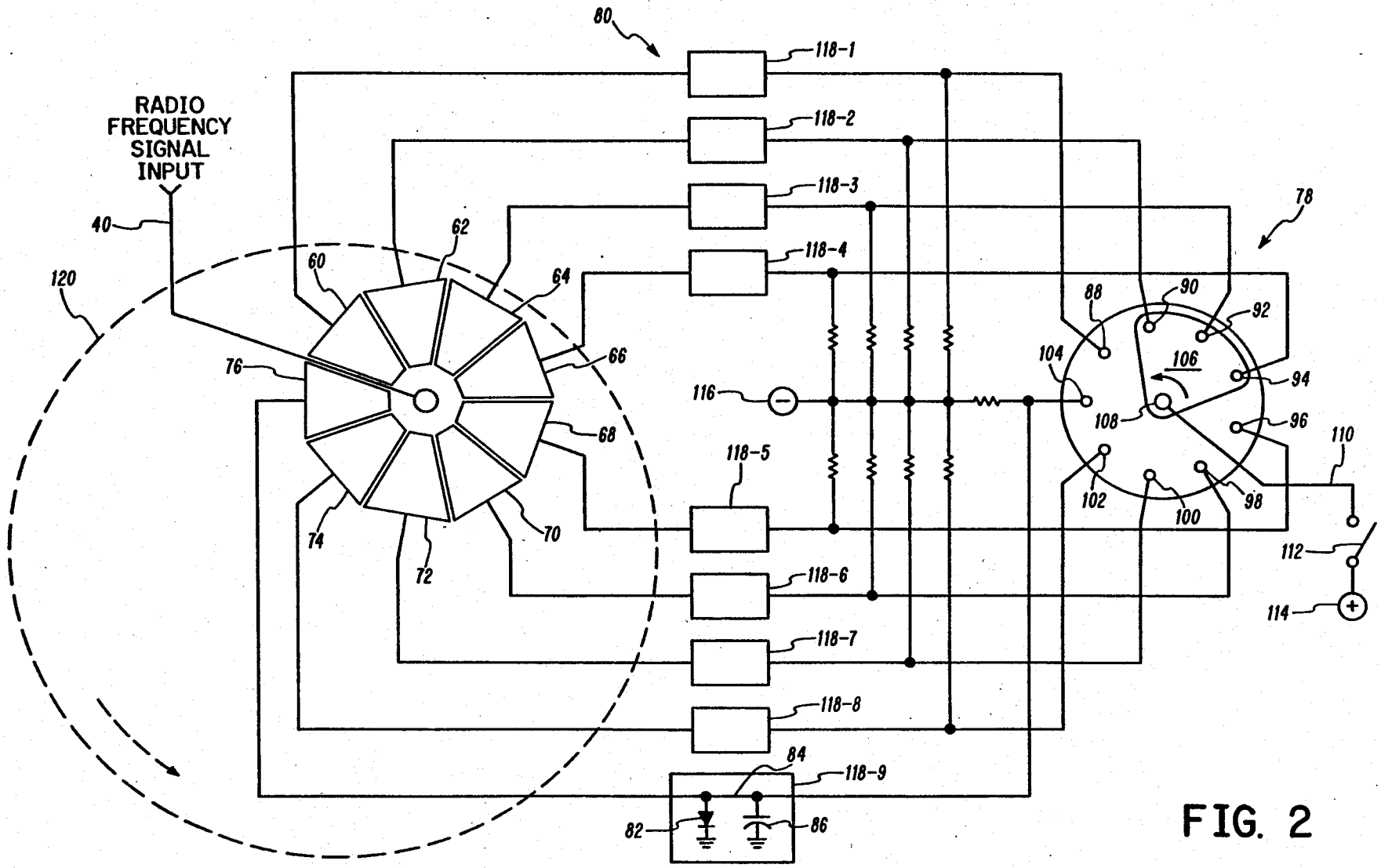

In FIG. 2 the electrical connection for radio frequency input signals is also shown as 40. The driven disk 44 and the toroid 18 of FIG. 1 is generally hidden beneath the pie-shaped elements of FIG. 2. Although the pie-shaped elements of FIG. 1 have been designated 48 and 50, the plurality of elements in FIG. 2 are given new designators from 60 to 76. These elements form a substantially circular shape even though as drawn they form a regular polygon. An electronic switch illustrated as a distributor or commutator generally designated as 78 has a plurality of contacts connected via a plurality of shorting strap circuit blocks generally designated as 80 to the pie-shaped elements 60 through 76. Each of the blocks 80 contain a pin diode such as 82, a quarter-wavelength termination line such as 84 and a capacitive element such as 86. The capacitive element 86 corresponds to the feedthrough capacitor illustrated in dash lines as 34 in FIG. 1 while the switching pin diode 82 corresponds to diode 26 in FIG. 1 and the quarter-wavelength termination line 84 corresponds to the quarter-wavelength terminating line device 24 of FIG. 1. The distributor 78 has a plurality of contacts 88 through 104 which are connected respectively to pie-shaped elements 60 through 76 via the shorting strap blocks 80. A rotating contact 106 in distributor 78 is normally connected to three of the outlying contacts and to one center contact 108 and then via a lead 110 and a switch 112 to a positive potential 114. If the switch 112 is open, a negative signal is supplied via a negative source 116 and each of the illustrated resistors to the diodes within the individual circuit elements 80 (designated 118 - 1 through 118 - 9). If, at the same time, a radio frequency input signal is input on lead 40, a radiation pattern is produced which is omnidirectional and centered on the antenna geometric center. The quarter-wave transmission line 84 transforms the low impedance at the feed-through capacitor 86 and presents a high impedance to the radio frequency signal at 82. A negative potential is applied to prevent the rectified radio signal from operating the pin diode. However, if switch 112 is closed such that the three pie-shaped elements 62, 64 and 66 are connected to the positive DC voltage from terminal 114, the radiation pattern is perturbed such that the pattern is no longer omnidirectional but rather is off-centered in a manner similar to that shown by dash line 120. This pattern is considered to be directional in that there is more of a field in the southwest corner of the drawing than there is in the northeast corner. As the commutator 106 rotates, the direction of the maximum field around the toroid 18 of FIG. 1 is also altered.

OPERATION

As previously indicated, the present invention comprises a flush mounted antenna to perform the same function as the antenna in the referenced patent application. To simplify the reduction of practice of a working embodiment, the present invention utilized nine sectors for the pie-shaped elements whereby the same electronics could be used to test the device as was used in the referenced patent application.

The prior antenna of the referenced patent application being surface mounted utilized the switching of nine parasitic monopoles arranged in a circle around the primary center radiating element which comprised a broadband monopole. Such a device cannot merely be recessed into a cavity and covered with a signal radiation transparent membrane since the recessing seriously and detrimentally affects the radiation pattern of the antenna element unless the cross-sectional area of the cavity is very large. Rather, a new design of antenna was devised. The antenna element of FIG. 1 with no pie-shaped elements and no electronic switching produces a pattern which emanates from the cavity across the gap between element 44 and the skirts 16 of the cavity. In other words, the radiation pattern is a donut shaped or toroid shaped radiation pattern which is omnidirectional from the cavity with a null over the center. By adding to this element 44 nine pie-shaped sections illustrated as 60 through 76 in FIG. 2 and selectively grounding these elements to the ground plane 10, this previously omnidirectional radiation pattern is unbalanced.

When a radio frequency signal input is applied to lead 40 at the center of the disk 44, these signals are coupled to the elements 48 and 50 of FIG. 1 or elements 60 to 76 of FIG. 2 on the surface of the antenna. When the coupling elements are divided into pie-shaped segments such as shown in FIG. 1, and some of these adjacent elements are shorted to the cavity wall or skirt 16 or the ground plane 10 via the pin diodes such as 82 within blocks 80, an eccentric radiation pattern is introduced, as long as the remaining elements 60 to 76 are left open circuited.

A modulation of the pattern is created using the present technique and the radiation pattern when being used as a transmitter is directional as intended.

While the electronic switching is shown as being performed by a mechanically operated commutator in FIG. 2, it is to be realized that such a function can easily be designed using solid state components so that there are no moving parts. The mechanical switch was shown merely for the purposes of ease of illustration in describing the inventive concept. This switching function can easily be designed using solid state components so that there are no moving parts.

It is to be realized by those skilled in the art that we are merely showing a first embodiment of the inventive concept, and that we wish to be limited not to the specific embodiment shown but only by the scope of the inventive concept of unbalancing the normally omnidirectional field by shorting some of the sections of an assemblage of elements of a capacitively coupled surface cooperating with a cavity mounted primary radiator disk to produce a directional radiation pattern in the transmitting mode as described in the appended claims wherein we claim:

1. Electronically switched flush mounted radiating antenna means comprising, in combination:

ground plane means;

cavity means of diameter D and depth H mounted in said ground plane means and electrically connected thereto;

circular transmission signal feed element means centrally located in said cavity means;

a set of conductive pie-shaped elements forming a substantially circular assembly and having a diameter of less than D, and substantially the same diameter as said circular feed element means, mounted flush with said ground plane means and centered over said feed element means, said pie-shaped elements being capacitively coupled to said feed element means at transmission signal frequencies and being electrically insulated from said feed element means for direct current voltages;

means for supplying transmission signals to said feed element means, said feed element means in said cavity and in combination with said pie-shaped elements forming an omnidirectional transmission pattern emanating from the gap between said pie-shaped element and edges of said cavity means; and grounding means, connected to each of said pie-shaped elements for selectively grounding adjacent pie-shaped elements to unbalance said omnidirectional transmission pattern whereby the transmission pattern is selectively directional.

2. Antenna comprising, in combination:

a ground plane means having a circular cavity;

circular feed element means located in said cavity below the top of said ground plane means and having a diameter less than that of said cavity;

radiating conductive signal shaping means, comprising a plurality of triangular shaped elements having a substantially circular profile, mounted even with the top of said ground plane means, the shaping means having a diameter similar to that of said feed element means and a diameter less than that of the cavity, juxtaposed said feed element means and in combination with said signal shaping means producing an omnidirectional signal; and signal redirection means for selectively and electrically connecting at least one of said signal shaping means to said ground plane means to modify the output transmission signal to be directional.

* * * * *